US005136339A

United States Patent [19]

Morita et al.

[11] Patent Number: 5,136,339

[45] Date of Patent: Aug. 4, 1992

[54] IMAGE FORMING APPARATUS HAVING A CASSETTE STORAGE MODE

[75] Inventors: Shizuo Morita; Masakazu Fukuchi; Shunji Matsuo; Satoshi Haneda, all of Tokyo, Japan

[73] Assignee: Konica Corporation, Tokyo, Japan

[21] Appl. No.: 671,102

[22] Filed: Mar. 18, 1991

[30] Foreign Application Priority Data

Mar. 20, 1990 [JP] Japan ..... 2-71236

[51] Int. Cl.[5] ..... G03G 21/00

[52] U.S. Cl. ..... 355/308; 271/127; 271/164; 355/210

[58] Field of Search ..... 355/210, 212, 308, 309, 355/311; 271/126, 127, 162, 164

[56] References Cited

U.S. PATENT DOCUMENTS 4,303,235 12/1981 Calabrese ..... 271/162
4,403,851 9/1983 Yanagawa ..... 355/309 X
4,538799 9/1985 Bhagwat ..... 271/164 X
4,754,293 6/1988 Aizawa et al. ..... 355/309 X
4,896,191 1/1990 Ohyabu et al. ..... 355/309

*Primary Examiner*—Fred L. Braun
*Attorney, Agent, or Firm*—Finnegan, Henderson, Farabow, Garrett and Dunner

[57] ABSTRACT

An image forming apparatus wherein a recording paper receiving cassette can be moved to a first position where the cassette is stored in the apparatus body and a second position where one portion of the cassette is withdrawn from the apparatus body so that the paper feed can be carried out, wherein when the cassette is withdrawn further from the apparatus body the cassette can be removed from the apparatus body. A process cartridge including a photosensitive belt and a plurality of developing devices are arranged around the photosensitive belt. The process cartridge is disposed above the recording paper receiving cassette, wherein the process cartridge can be withdrawn in the same direction as that of the recording paper receiving cassette when the recording paper feed path is opened.

6 Claims, 5 Drawing Sheets

IMAGE FORMING APPARATUS HAVING A CASSETTE STORAGE MODE

BACKGROUND OF THE INVENTION

1. Field of the Invention

The present invention relates to a color image forming apparatus wherein a color toner image is formed on a belt-shaped image retainer by an electrophotographic system and transferred to a transfer paper to form a color image.

2. Description of the Prior Art

Many kinds of color image forming apparatuses have been proposed. In the typical color image forming apparatus, a belt-shaped image retainer (photosensitive) is trained around two rollers, and a plurality of developing devices including toners different in color from one another are disposed below the lower flight of said photosensitive belt. A color image is formed on the photosensitive belt by forming latent images corresponding to the color separation number of a document image on said photosensitive belt and developing the latent images by said plural developing devices every time the latent image is formed while rotating the photosensitive belt plural times to form a color toner image, and then said color toner image is transferred at a time to a transfer paper supplied from a paper feed cassette in a cassette receiving room disposed below the plural developing devices to obtain a color copy.

In such a color image forming apparatus, U-turn of a small curvature radius of the photosensitive belt is practicable different from the photosensitive drum, so that the photosensitive belt can run along the flat plane and the space can be utilized effectively. Further, by providing a separation electrode for transfer papers to which images have been transferred at the U-turn portion of the small curvature radius, the transfer papers can be separated positively.

In said color image forming apparatus, the photosensitive belt and the cassette receiving room are disposed in the form of layers at both sides of the plural developing devices. Paper feed means and a paper feed path connecting the cassette receiving room with a transfer portion of the photosensitive belt are provided along an inner side wall of the apparatus body so as to circulate around the plural developing devices. Further, a cassette insertion port of said cassette receiving room is formed in a side wall of the apparatus body opposite to said inner side wall at which said paper feed path and paper supply means are mounted, so that the feed paper cassette can be inserted in the same direction as the paper feed direction.

However, if such a style that the feed paper cassette is inserted into the cassette receiving room from the side opposite to the side at which the paper feed path and the paper feed means are provided is employed, it is necessary to open said two opposite side surfaces of the apparatus body arbitrarily for processing jamming or the like. Accordingly, a large space for the apparatus is required and the operations of copying and the maintenance become difficult.

In order to solve the above problems, there is proposed an image forming apparatus wherein the cassette insertion port is provided on the side surface of the apparatus at which the paper feed path is provided so as to carry out from one side surface of the apparatus body all of the operations such as the insertion of the paper feed cassette and maintenance such as the processing of jamming.

The length of the peripheral surface of the photosensitive belt becomes twice longer than the distance between said two rollers, so that the photosensitive belt can have an image forming portion of a length substantially twice the distance between the two rollers.

However, in case that a transfer paper corresponding to said image forming portion is longer than the depth of the image forming apparatus, the paper feed cassette containing such long transfer paper becomes over the depth of the image forming apparatus, so that the paper feed must be carried out in a state that a portion of the cassette projects from the front surface of the apparatus body. Accordingly, the floor space for the apparatus becomes large and the cassette would disturb person's walking and operations at the inoperative state of the apparatus.

SUMMARY OF THE INVENTION

An object of the present invention is to provide an image forming apparatus wherein such a long paper feed cassette as mentioned above can be stored in the apparatus body at the inoperative state.

The above object can be attained by an image forming apparatus comprising: a main body; an image forming member for forming an image, the image forming member being disposed in said main body; and a recording paper cassette for storing a recording paper, the cassette being moved to a first position where the cassette is stored in the main body whereby the recording paper is not feeded at the first position and a second position where the cassette is substantially withdrawn from the main body so that the recording paper is feeded to the image forming member at the second position.

The above and other objects as well as advantageous features of the invention will become apparent from the following description of the embodiments taken in conjunction with the accompanying drawings.

DESCRIPTION OF PREFERRED EMBODIMENTS

An embodiment of an image forming apparatus according to the present invention will be explained.

Figure 1:
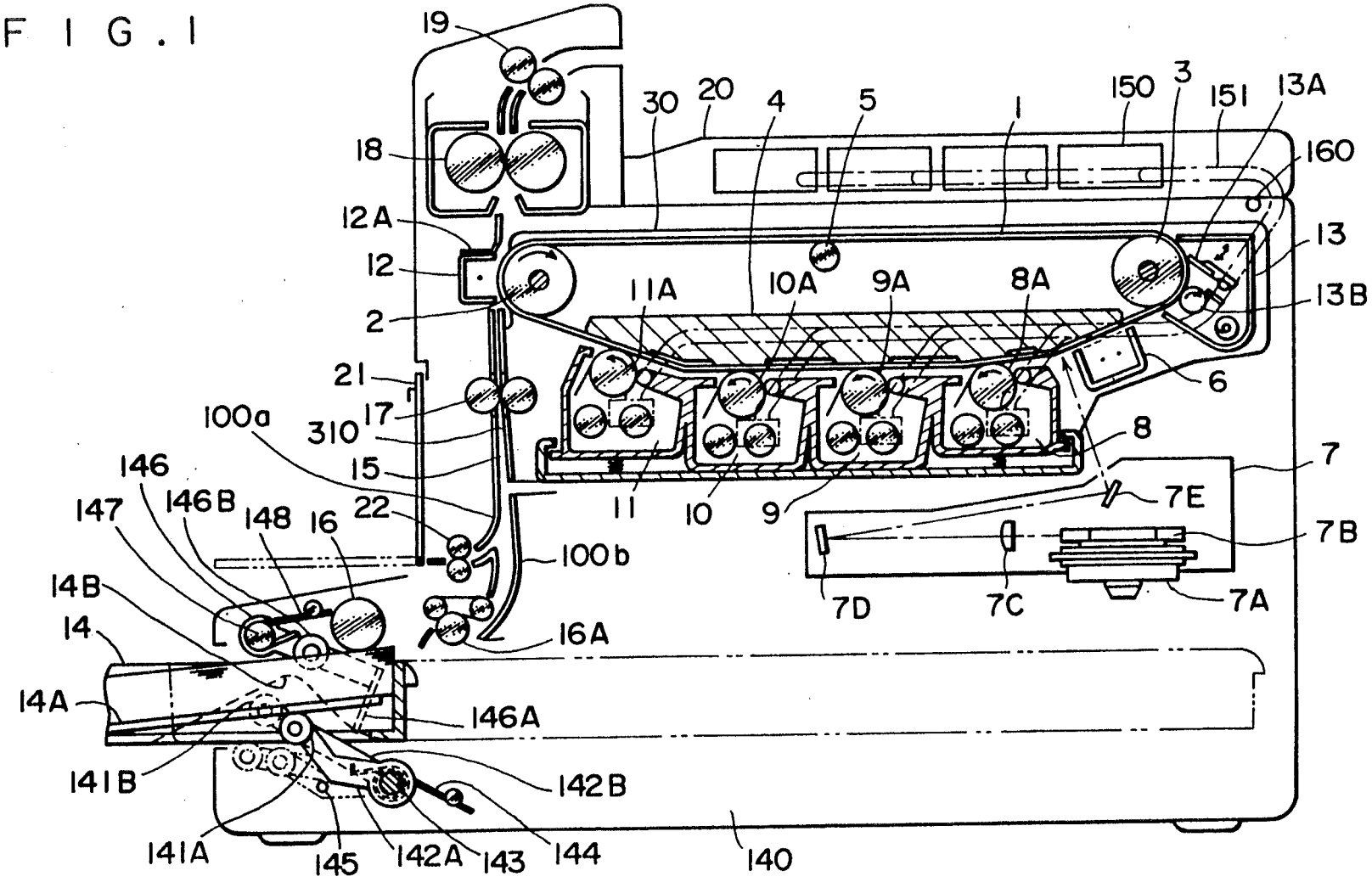
FIG. 1 is a sectional view of an image forming apparatus according to the present invention.

Referring to FIG. 1, a reference numeral 1 denotes a flexible photosensitive belt constituting a belt-shaped image retainer, which is trained around a drive roller 2 and a driven roller 3 and rotated clockwise by the driving force of the drive roller 2.

A reference numeral 4 denotes a guide member fixed to the apparatus body so as to contact with the lower flight of the photosensitive belt 1. Said photosensitive belt is tensed by an operation of an upwardly biased tension roller 5 to be brought into slidably contact at the inner circumferential surface thereof with the guide member 4.

Accordingly, by the guide member 4 and the tension roller 5 a stable image forming surface can be obtained on the photosensitive belt 1.

A reference numeral 6 denotes a charging device, such as a scorotron charger, 7 denotes a laser writing unit, which is an image exposing means. In the laser writing unit 7, an optical system of a unitary combination of a light emitting element and a convergent light transmission member can be used, besides the optical system shown in the drawing.

Reference numerals 8 to 11 denote a plurality of developing devices, i.e. developing means containing developers of different colors, such as yellow, magenta, cyan and black. These developing means are arranged facing the photosensitive belt 1 blacked by the guide member 4.

The developing devices 8, 9, 10 and 11 are provided with developing sleeves 8A, 9A, 10A and 11A which are separated by a predetermined distance from the photosensitive belt 1, the developing devices having functions of turning a latent image on the photosensitive belt 1 into a visible image by a non-contact developing method. This non-contact developing method, unlike the contact developing method, has an advantage that the movement of the photosensitive belt 1 is not interfered with.

A reference numeral 12 denotes a transfer device, 12A denotes a charge eliminating bar, and 13 denotes a cleaning device. A blade 13A and a toner feeding roller 13B in this cleaning device 13 are retained in positions apart from the surface of the photosensitive belt 1 during the formation of toner image, and they are pressed against the surface of the photosensitive belt 1 as shown in the drawing, only while a cleaning operation is carried out after the completion of the transferring of the toner image.

Figure 2:
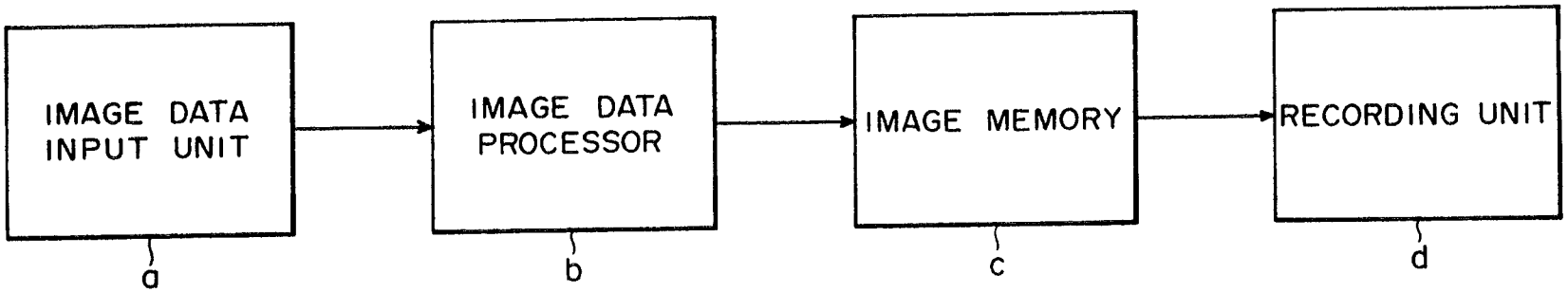
FIG. 2 is a block diagram showing an image forming system.

A color image recording process by this color image forming apparatus is carried out as follows:

The formation of a multi-color image by this embodiment is carried out in accordance with an image formation system shown in FIG. 2. Namely, the data obtained in a color image data input unit a in which an original image is scanned by an image pickup element are operated in an image data processor b to prepare image data and store the data temporarily in an image memory c. The image data are then taken out in a recording step and inputted into, for example, the color image forming apparatus serving as a recording unit d of the embodiment of FIG. 1.

Specifically, when a color signal outputted from an image reading apparatus provided independent of the color image forming apparatus is inputted into the laser writing unit 7, a laser beam emitted from a semiconductor laser (not shown) is subjected to rotational scanning by a polygon mirror 7B therein which is turned by a driving motor 7A, and the optical path of the laser beam is then bent by mirrors 7D, 7E via an $f\theta$ lens 7C, the laser beam being thereafter projected on the circumferential surface of the photosensitive belt 1 which has been charged by the charging device 6 provided as a charging means to form a static latent image.

When the scanning is started, the laser beam is detected by a index sensor, and the modulation of the laser beam in accordance with a first color signal is started, the circumferential surface of the photosensitive belt 1 being scanned with the modulated laser beam. Thus, a latent image corresponding to a first color is formed on the circumferential surface of the photosensitive belt 1 by the primary scanning with the laser beam and the auxiliary scanning based on the movement of the photosensitive belt 1. This latent image is developed by the developing device 8 containing a yellow (Y) toner (developing medium) among the developing means in this apparatus, to form a yellow toner image on the surface of the photosensitive belt 1. The toner image thus obtained and maintained on the photosensitive belt 1 passes under the blade 13A of the cleaning device 13 placed apart from the circumferential surface of the photosensitive belt 1 to proceed to a subsequent copying cycle.

The photosensitive belt 1 is charged again by the charging device 6, and a second color signal outputted from the signal processor is then inputted into the writing unit 7, the writing on the surface of the photosensitive belt 1 being done in the same manner as in the case of the writing based on the first color signal, to form a latent image. This latent image is developed by the developing device 9 containing a magenta (M) toner as a second color developer. This magenta toner image is formed in the presence of already-formed yellow toner image. Similarly, a cyan toner image is formed by the developing device 10 containing a cyan developer, and further a black toner image is formed by a developing device 11 containing a black developer and superposed on the already-formed toner images on the circumferential surface of the photosensitive belt 1. A DC or AC bias voltage is applied to the sleeves in these developing devices 8, 9, 10 and 11, and a jumping developing is carried out with a developing means, i.e. a two-component developer, whereby a non-contact development is carried out on the photosensitive belt 1 the base body of which is grounded. Otherwise, a non-contact development using a one-component developer may be selected.

The color toner image thus formed on the circumferential surface of the photosensitive belt 1 is transferred on a transfer paper.

In the embodiment according to the present invention, an image longer than the depth of the apparatus body can be formed and accordingly a recording paper of the special size longer than the standard size is used for such longer image.

The recording paper of the special size is set in an exclusive recording paper cassette 14 and the tip end portion of the cassette 14 is inserted into a cassette receiving room 140 formed on the bottom of the apparatus body to connect it with a recording paper feeding system in the apparatus, as shown in FIG. 1. The recording paper fed from the cassette 14 is forwarded toward the transfer device 12 through a paper feed path 15 consisting of forward guides 100*a* and 100*b* and cartridge side plates 310 etc.

A rotary shaft 143 is provided below an insertion path of the cassette 14 in said cassette receiving room 140 for rotating a push-up lever 142A and a driven lever 142B. The push-up lever 142A rotary supports a push-up roller 141A. The driven lever 142B rotary supports a roller 141B. The rotary shaft 143 is urged by a torsion spring 144 to be rotated clockwise. Said push-up roller 141A and said roller 141B are arranged so that the former is brought into contact with the central portion of a bottom plate 14A of the cassette 14 and the latter is brought into contact with an angular concave cam 14B formed on the back side surface of the cassette 14.

A release lever 146 is rotatably supported by a rotary shaft 147 at an upper portion of the insertion path of the cassette 14 and urged by a strong torsion spring 148 to be rotated clockwise. Said release lever 146 has at the tip end thereof a rising portion 146A and at a portion near the fulcrum thereof a roller 146B. Said rising portion 146A is positioned corresponding to said driven lever 142B and said roller 146B is positioned corresponding to the upper edge of the back side surface of the cassette 14.

Figure 3:
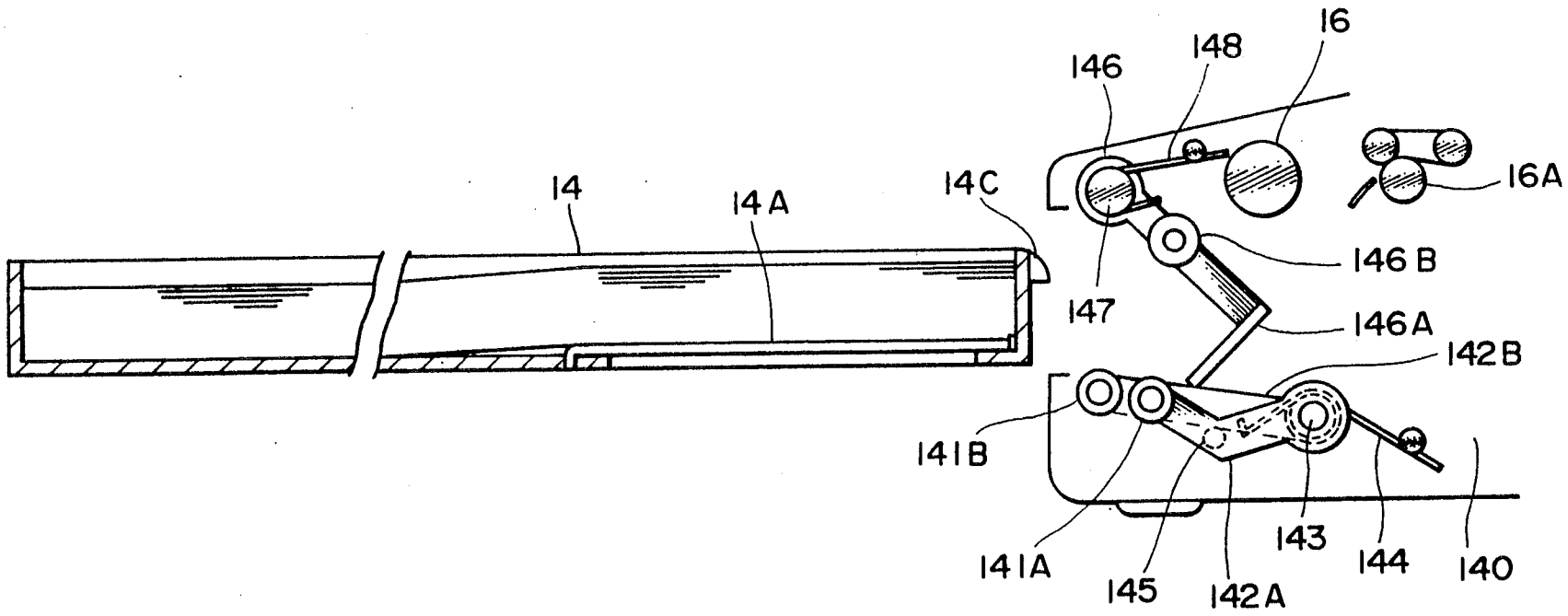
FIG. 3 is a view of an essential portion of the image forming apparatus.

In case that the cassette 14 is not loaded, said release lever 146 is rotated clockwise by the torsion spring 148 against the spring action of the torsion spring 144 so that the rising portion 146A of the release lever 146 urges said driven lever 142B to rotate counter-clockwise until the latter is brought into contact with a stopper 145, as shown in FIG. 3. In this state, said push-up roller 141A and said roller 141B are lowered below the insertion path of the cassette 14, whereas said roller 146B is moved to a position a little lower than the upper edge of the back side surface of the cassette 14 by the rotation of the release lever 146 in the clockwise direction.

When the cassette 14 is moved along a guide member (not shown) toward the cassette receiving room 140 in FIG. 3, a curved projection 14C mounted on the tip end of the back side surface of the cassette 14 moves said roller 146B upwards, so that the roller 146B rides on the upper edge of the back side surface of the cassette 14. As a result, said release lever 146 is rotated counter-clockwise, so that the driven lever 142B is rotated clockwise and the bottom plate 14A in the cassette 14 is pushed up by the push-up roller 141A.

Accordingly, the recording paper of the special size piled on the bottom plate 14A is brought into contact under pressure with a paper feed roller 16 and according to the rotations of said paper feed roller 16 and a handling roller 16A an uppermost recording paper is taken out and fed.

The special size recording papers taken out of the cassette 14 are fed sheet by sheet to the paper feed path 15 and supplied to the transfer device 12 through timing rollers 17 in synchronism with the image formation on the photosensitive belt 1.

As stated above, the recording paper which has been fed to the transfer device 12 and subjected to the transferring of the toner image and the charge elimination is separated reliably from the photosensitive belt 1, the direction of which is suddenly changed (small curvature radius) along the drive roller 2, to advance upward. The toner image is then fixed by a fixing roller 18 and thereafter the recording paper is delivered onto a tray 20 via a paper delivery roller 19 and stacked in the tray 20.

On the other hand, after completing the image transfer to the recording paper, the photosensitive belt 1 still continues its movement to remove the remaining toner by said cleaning device 13 wherein the blade 13A and the toner feeding roller 13B are in contact with the belt 1. With this process completed, said blade 13A is again separated. Slightly after that, the toner supply roller 13B smooths the toner deposited on the top end of the blade 13A. Then the toner feeding roller 13B is separated and the system proceeds to the next image forming process.

When said cassette 14 is pushed and moved from a position shown in FIG. 1 to a position in the cassette receiving room 140, the cassette 14 urges the roller 141B through the left side slope of the angular concave cam 14B to rotate the rotary shaft 143 counter-clockwise. Accordingly, the push-up roller 141A is moved to a position shown by a single-dot-and-dash line below the bottom surface of the cassette 14, in FIG. 1.

As a result, it is possible to store the cassette 14 with the recording papers and the bottom plate 14A lowered at a position in the cassette receiving room 140 shown by a double-dot-and-dash line in FIG. 1. Specifically, said cassette 14 can be set selectively at one of a first position where said cassette 14 is stored in the apparatus body and a second position where the cassette 14 is withdrawn from the apparatus body for supplying the recording paper.

When the cassette 14 is withdrawn further from said second position, said roller 141B is urged by the right side slope of the angular concave cam 14B to rotate the rotary shaft 143 counter-clockwise, so that the push-up roller 141A is retracted from the cassette 14. Accordingly, the cassette 14 can easily be removed from the cassette receiving room 140.

When the cassette 14 is removed from the apparatus body, the roller 146B becomes free, so that the release lever 146 rotates clockwise to rotate the driven lever 142B counter-clockwise by the rising portion 146A of the release lever 146. The driven lever 142B is stopped its rotation by the stopper 145 and returned to the position shown in FIG. 3, again. At this state, the push-up roller 141A and the roller 141B are both moved to a position below the insertion path of the cassette 14, whereas the roller 146B is held at a position corresponding to a projection 14C of the cassette 14.

The photosensitive belt 1 and the developing devices are formed as a cartridge unit 30 together with the charging means 6, cleaning device 13 and recording paper feed way including the paper feed path 15 and timing roller 17. The cartridge 30 can be inserted into and detached from the apparatus body, and when it is inserted each toner supply tube 151 of a toner hopper 150 is connected to each developing device automatically, so that toner can be supplied.

The apparatus according to the present invention has a manual insertion means for the recording paper other than said automatic paper feed means. In case that paper is supplied by the manual insertion means, as shown in FIG. 1, a manual insertion guide plate 21 mounted on the side portion of the apparatus body is turned horizontally to make an opening and each of the recording papers is inserted through the opening and fed to said paper feed path 15 through a manual insertion guide roller 22.

The apparatus body has a clam-shell construction which can be divided into upper and lower members. The upper member includes the toner hopper 150 and the lower member includes the cartridge unit 30, laser writing unit 7, and cassette receiving room 140 etc., the upper member and the lower member being connected rotatably by a pivot pin 160, so that the upper member can be opened with respect to the lower member and maintained at the open state as shown in FIG. 4.

Figure 4:
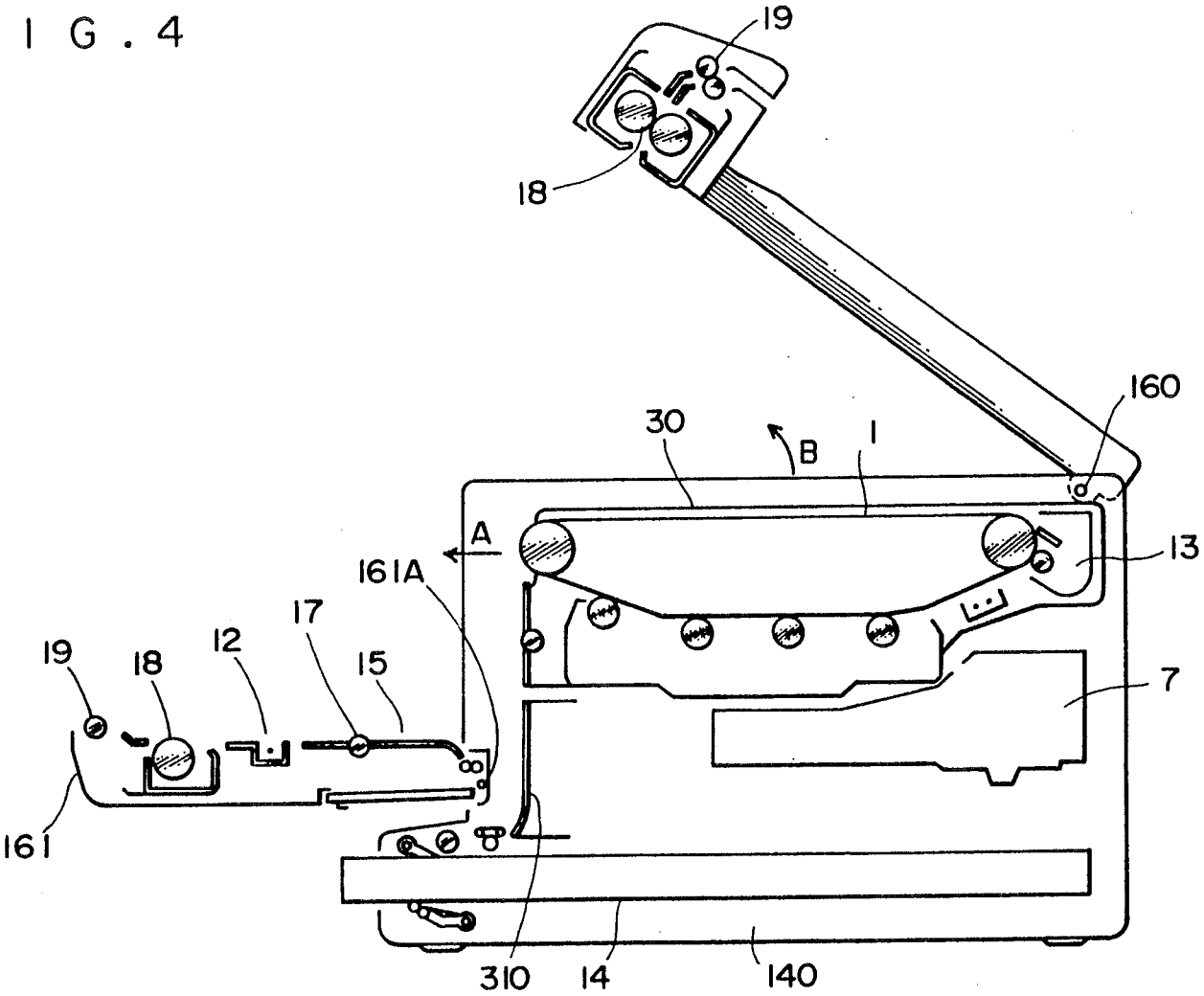
FIG. 4 is a view for explaining the image forming apparatus.

A side cover 161 is provided pivotally around a pivot pin 161A to open and close the left side surface of the lower member as shown in FIG. 4. In such construction, the entire area of the recording paper feed way extending from the paper feed path 15 to a paper discharge roller 19 can be opened by rotating the side cover 161 counter-clockwise centering around the pivot pin 161A. The cartridge 30 can easily be inserted into and removed from the lower member by sliding the cartridge 30 horizontally as shown in an arrow A or vertically as shown in an arrow B.

Figure 5:
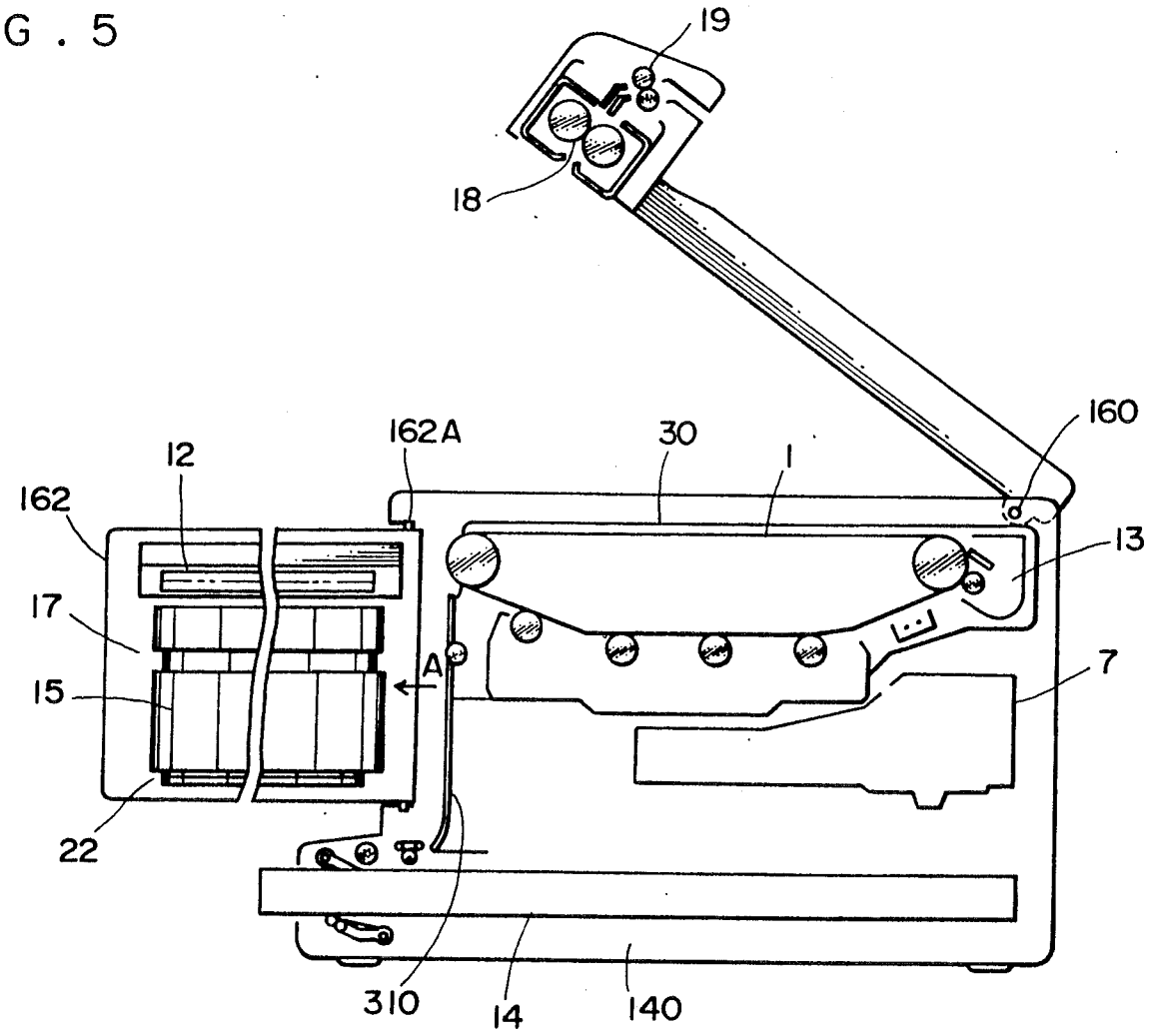
FIG. 5 is a view for explaining the other embodiment of an image forming apparatus of this invention.

FIG. 5 shows a second embodiment of the present invention wherein a side cover 162 is provided rotatably horizontally centering around a pivot pin 162A to open and close the left side surface of the lower member. The side cover 162 holds the transfer device 12, manual insertion guide plate 21, manual insertion guide roller 22, the paper feed path 15 and halves of pair of the timing rollers 17.

When the side cover 162 is opened, the cartridge 30 and the cassette 14 can be removed by sliding them leftwards as shown in an arrow A while maintaining horizontal state thereof. Further, as shown in FIG. 5, it is possible to extend a cartridge side plate 310 to the lower portion in order to form the paper feed path 15.

In the other embodiment, the process cartridge can be composed of a photosensitive belt and a cleaning device, and it is not always necessary to provide a plurality of developing devices below the process cartridge as a unit on the contrary to the preceding embodiment.

EFFECT OF THE INVENTION

According to the present invention, the recording paper receiving cassette for feeding recording papers in the state that a portion of the cassette is projected from the apparatus body can be inserted into and removed from the apparatus body with very simple constructions. As a result, it is possible to provide an image forming apparatus wherein a toner image of a special size can be transferred to a recording paper by using a belt-shaped image retainer.

What is claimed is:

1. An image forming apparatus comprising:

a main body;

an image forming member for forming an image, the image forming member being disposed in said main body;

a recording paper cassette for storing a recording paper;

means for feeding the paper from the cassette to the image forming member; and means for allowing movement of the cassette to a first position within the main body where the cassette is stored in a position where the cassette and the feeding means are not operative together whereby the recording paper is not fed and for allowing movement of the cassette to a second position where the cassette is substantially withdrawn from the main body and where the feeding means and the cassette are operative together whereby the recording paper may be fed to the image forming member.

2. The apparatus of claim 1 wherein the cassette can be removed from the main body when the cassette is withdrawn further from the main body.

3. The apparatus of claim 1 further comprising a process cartridge including a photosensitive belt, the process cartridge being disposed above the cassette, wherein the process cartridge can be withdrawn from the main body in the same direction as that of the cassette when a feeding path of the recording paper is opened.

4. The apparatus of claim 3 wherein the process cartridge further comprises a plurality of developing devices arranged around the photosensitive belt.

5. The apparatus of claim 3 wherein the process cartridge further comprises a plurality of developing devices arranged between the photosensitive belt and the cassette.

6. The apparatus of claim 1 further comprising a discharging portion for discharging the recording paper after the image is transferred onto the recording paper, wherein the discharging portion is capable of being opened against the main body.

* * * * *